US005593807A

United States Patent [19]

Sacripante et al.

[11] Patent Number: 5,593,807

[45] Date of Patent: Jan. 14, 1997

[54] TONER PROCESSES USING SODIUM SULFONATED POLYESTER RESINS

[75] Inventors: Guerino G. Sacripante; Raj D. Patel, both of Oakville, Canada

[73] Assignee: Xerox Corporation, Stamford, Conn.

[21] Appl. No.: 644,882

[22] Filed: May 10, 1996

[51] Int. Cl.[6] ..... G03G 9/87

[52] U.S. Cl. ..... 430/137; 523/334; 523/335

[58] Field of Search ..... 430/137; 523/334, 523/335

[56] References Cited

U.S. PATENT DOCUMENTS

| | | | |
|---|---|---|---|
| 4,983,488 | 1/1991 | Tan et al. | 430/137 |
| 4,996,127 | 2/1991 | Hasegawa et al. | 430/109 |
| 5,290,654 | 3/1994 | Sacripante et al. | 430/137 |
| 5,348,832 | 9/1994 | Sacripante et al. | 430/137 X |
| 5,364,729 | 11/1994 | Kmiecik-Lawrynowicz et al. | 430/137 |
| 5,403,693 | 4/1995 | Patel et al. | 430/137 |

*Primary Examiner*—Roland Martin
*Attorney, Agent, or Firm*—E. O. Palazzo

[57] ABSTRACT

A process for the preparation of toner compositions comprising:

(i) preparing an emulsion latex comprised of sodio sulfonated polyester resin particles of from about 5 to about 500 nanometers in size diameter by heating said resin in water at a temperature of from about 65° C. to about 90° C.

(ii) preparing a pigment dispersion in a water by dispersing in water from about 10 to about 25 weight percent of sodio sulfonated polyester and from about 1 to about 5 weight percent of pigment;

(iii) adding the pigment dispersion to a latex mixture comprised of sulfonated polyester resin particles in water with shearing, followed by the addition of an alkali halide in water until aggregation results as indicated by an increase in the latex viscosity of from about 2 centipoise to about 100 centipoise;

(iv) heating the resulting mixture at a temperature of from about 45° C. to about 80° C. thereby causing further aggregation and enabling coalescence, resulting in toner particles of from about 4 to about 9 microns in volume average diameter and with a geometric distribution of less than about 1.3; and optionally (v) cooling the product mixture to about 25° C. and followed by washing and drying.

23 Claims, No Drawings

TONER PROCESSES USING SODIUM SULFONATED POLYESTER RESINS

BACKGROUND OF THE INVENTION

The present invention is generally directed to toner processes, and more specifically, to aggregation and coalescence processes for the preparation of toner compositions. In embodiments, the present invention is directed to the economical chemical in situ preparation of toners without the utilization of the known pulverization and/or classification methods, and wherein in embodiments toner compositions with a volume average diameter of from about 1 to about 25, and preferably from 1 to about 10 microns and narrow GSD of, for example, from about 1.16 to about 1.26 as measured on the Coulter Counter can be obtained. The resulting toners can be selected for known electrophotographic imaging, printing processes, including color processes, and lithography. In embodiments, the present invention is directed to a surfactant free process comprised of forming a latex of a polyester, such as a sodium sulfonated polyester resin in water, mixing the latex with a pigment dispersion containing an alkali halide, such as calcium chloride, to form aggregates, and thereafter, heating the formed aggregates to enable the generation of coalesced toner particles. The polyester resin selected preferably contains sulfonated groups thereby rendering them dissipatable, that is, they form spontaneous emulsions without the use of organic solvents, in water above the glass transition temperature, Tg, of the polyester resin. The process of the present invention can be considered a surfactant free chemical method wherein sulfopolyester particles are aggregated with ionic salts, such as magnesium chloride, under high shearing conditions followed by heating for coalescence and wherein during the heating no surfactants are utilized. Heating the mixture about above or in embodiments equal to the resin Tg generates toner particles with, for example, an average particle volume diameter of from about 1 to about 25 and preferably 10 microns. It is believed that during the heating stage, the components of aggregated particles fuse together to form composite toner particles. In another embodiment thereof, the present invention is directed to an in situ process comprised of first dispersing a pigment, such as HELIOGEN BLUE™ or HOSTAPERM PINK™, reference the Color Index, in an aqueous mixture utilizing a high shearing device, such as a Brinkmann Polytron, microfluidizer or sonicator, thereafter shearing this mixture with a latex of suspended polyester resin particles, and which particles are preferably, for example, of a size ranging from about 5 to about 500 nanometers in volume average diameter, as measured by the Brookhaven nanosizer. Thereafter, the aforesaid mixture is treated with an ionic salt, such as an alkali halide, thereby resulting in a flocculation, or heterocoagulation of the resin particles with the pigment particles; and which, on further stirring for about 1 to about 3 hours while heating, for example, from about 35° to about 45° C., results in the formation of statically bound aggregates ranging in size of from about 0.5 micron to about 10 microns in average diameter size as measured by the Coulter Counter (Microsizer II), where the size of those aggregated particles and their distribution can be controlled by the temperature of heating, for example from about 5° to about 25° C. below the resin Tg, and where the speed at which toner size aggregates are formed can also be controlled by the temperature. Thereafter, heating from about 5° to about 50° C. above the resin Tg provides for particle fusion or coalescence of the polymer and pigment particles; followed by optional washing with, for example, hot water to remove residual surfactants and drying whereby toner particles comprised of resin and pigment with various particle size diameters can be obtained, such as from 1 to about 20, and preferably 12 microns in volume average particle diameter. The aforementioned toners are especially useful for the development of colored images with excellent line and solid resolution, and wherein substantially no background deposits are present.

In reprographic technologies, such as xerographic and ionographic devices, toners with volume average diameter particle sizes of from about 9 microns to about 20 microns are effectively utilized. Moreover, in some xerographic technologies, such as the high volume Xerox Corporation 5090 copier-duplicator, high resolution characteristics and low image noise are highly desired, and can be attained utilizing the small sized toners of the present invention with, for example, a volume average particle of from about 2 to about 11 microns and preferably less than about 7 microns, and with narrow geometric size distribution (GSD) of from about 1.16 to about 1.3. Additionally, in some xerographic systems wherein process color is utilized, such as pictorial color applications, small particle size colored toners, preferably of from about 3 to about 9 microns, are highly desired to avoid paper curling. Paper curling is especially observed in pictorial or process color applications wherein three to four layers of toners are transferred and fused onto paper. During the fusing step, moisture is driven off from the paper due to the high fusing temperatures of from about 130° C. to 160° C. applied to the paper from the fuser. Where only one layer of toner is present, such as in black or in highlight xerographic applications, the amount of moisture driven off during fusing can be reabsorbed proportionally by paper and the resulting print remains relatively flat with minimal curl. In pictorial color process applications wherein three to four colored toner layers are present, a thicker toner plastic level present after the fusing step can inhibit the paper from sufficiently absorbing the moisture lost during the fusing step, and image paper curling results. These and other disadvantages and problems are avoided or minimized with the toners and processes of the present invention. It is preferable to use small toner particle sizes, such as from about 1 to 7 microns, and with higher pigment loading, such as from about 5 to about 12 percent by weight of toner, such that the mass of toner layers deposited onto paper is reduced to obtain the same quality of image and resulting in a thinner plastic toner layer on paper after fusing, thereby minimizing or avoiding paper curling. Toners prepared in accordance with the present invention enable in embodiments the use of lower image fusing temperatures, such as from about 120° C. to about 150° C., thereby avoiding or minimizing paper curl. Lower fusing temperatures minimize the loss of moisture from paper, thereby reducing or eliminating paper curl. Furthermore, in process color applications, and especially in pictorial color applications, toner to paper gloss matching is highly desirable. Gloss matching is referred to as matching the gloss of the toner image to the gloss of the paper. For example, when a low gloss image of preferably from about 1 to about 30 gloss is desired, low gloss paper is utilized, such as from about 1 to about 30 gloss units as measured by the Gardner Gloss metering unit, and which after image formation with small particle size toners, preferably of from about 3 to about 5 microns and fixing thereafter, results in a low gloss toner image of from about 1 to about 30 gloss units as measured by the Gardner Gloss metering unit. Alternatively, when higher image gloss is desired, such as from about 30 to about 60 gloss units as measured by the Gardner Gloss metering unit, higher gloss paper is utilized, such as from about 30 to about 60 gloss units, and which after image formation with small particle size toners of the present invention of preferably from about 3 to about 5 microns, and fixing thereafter results in a higher gloss toner image of from about 30 to about 60 gloss units as measured by the Gardner Gloss metering unit. The aforementioned toner to paper matching can be attained with small particle size toners, such as less than 7 microns and preferably less than 5 microns, such as from about 1 to about 4 microns, whereby the pile height of the toner layer or layers is considered low and acceptable.

Numerous processes are known for the preparation of toners, such as, for example, conventional processes wherein a resin is melt kneaded or extruded with a pigment, micronized and pulverized to provide toner particles with a volume average particle diameter of from about 9 microns to about 20 microns and with broad geometric size distribution of from about 1.4 to about 1.7. In these processes, it is usually necessary to subject the aforementioned toners to a classification procedure such that the geometric size distribution of from about 1.2 to about 1.4 is attained. Also, in the aforementioned conventional process, low toner yields after classifications may be obtained. Generally, during the preparation of toners with average particle size diameters of from about 11 microns to about 15 microns, toner yields range from about 70 percent to about 85 percent after classification. Additionally, during the preparation of smaller sized toners with particle sizes of from about 7 microns to about 11 microns, lower toner yields can be obtained after classification, such as from about 50 percent to about 70 percent. With the processes of the present invention in embodiments, small average particle sizes of, for example, from about 3 microns to about 9 microns, and preferably 5 microns are attained without resorting to classification processes, and wherein narrow geometric size distributions are attained, such as from about 1.16 to about 1.30, and preferably from about 1.16 to about 1.25. High toner yields are also attained such as from about 90 percent to about 98 percent in embodiments of the present invention. In addition, by the toner particle preparation process of the present invention in embodiments, small particle size toners of from about 3 microns to about 7 microns can be economically prepared in high yields, such as from about 90 percent to about 98 percent by weight based on the weight of all the toner material ingredients, such as toner resin and pigment.

There is illustrated in U.S. Pat. No. 4,996,127 a toner of associated particles of secondary particles comprising primary particles of a polymer having acidic or basic polar groups and a coloring agent. The polymers selected for the toners of the '127 patent can be prepared by an emulsion polymerization method, see for example columns 4 and 5 of this patent. In column 7 of this '127 patent, it is indicated that the toner can be prepared by mixing the required amount of coloring agent and optional charge additive with an emulsion of the polymer having an acidic or basic polar group obtained by emulsion polymerization. In U.S. Pat. No. 4,983,488, there is disclosed a process for the preparation of toners by the polymerization of a polymerizable monomer dispersed by emulsification in the presence of a colorant and/or a magnetic powder to prepare a principal resin component and then effecting coagulation of the resulting polymerization liquid in such a manner that the particles in the liquid after coagulation have diameters suitable for a toner. It is indicated in column 9 of this patent that coagulated particles of 1 to 100, and particularly 3 to 70, are obtained. The disadvantage, for example, of poor GSD requires classification resulting in low toner yields, reference for example U.S. Pat. No. 4,797,339, wherein there is disclosed a process for the preparation of toners by resin emulsion polymerization, wherein similar to the '127 patent certain polar resins are selected, and wherein flocculation as in the present invention is not believed to be disclosed; and U.S. Pat. No. 4,558,108, wherein there is disclosed a process for the preparation of a copolymer of styrene and butadiene by specific suspension polymerization.

In U.S. Pat. No. 5,290,654, the disclosure of which is totally incorporated herein by reference, there is illustrated a process for the preparation of toners comprised of dispersing a polymer solution comprised of an organic solvent and a polyester, and homogenizing and heating the mixture to remove the solvent and thereby form toner composites.

Emulsion/aggregation/coalescing processes for the preparation of toners are illustrated in a number of Xerox patents, the disclosures of which are totally incorporated herein by reference, such as U.S. Pat. No. 5,290,654, U.S. Pat. No. 5,278,020, U.S. Pat. No. 5,308,734, U.S. Pat. No. 5,346,797, U.S. Pat. No. 5,370,963, U.S. Pat. No. 5,344,738, U.S. Pat. No. 5,403,693, U.S. Pat. No. 5,418,108, U.S. Pat. No. 5,364,729, and U.S. Pat. No. 5,346,797.

SUMMARY OF THE INVENTION

It is an object of the present invention to provide toner processes with many of the advantages illustrated herein.

In another object of the present invention there are provided simple and economical processes for the direct preparation of black and colored toner compositions with, for example, excellent pigment dispersion and narrow GSD.

In another object of the present invention there are provided simple and economical in situ surfactant free processes for black and colored toner compositions by an emulsion aggregation process, and wherein a sulfonated polyester is selected as the resin, reference copending patent application U.S. Ser. No. 221,595, the disclosure of which is totally incorporated herein by reference.

In a further object of the present invention there is provided a process for the preparation of sulfonated polyester containing toner compositions with an average particle volume diameter of from between about 1 to about 20 microns, preferably from about 1 to about 7 microns, and more preferably 3.3, 6.1, and 9 microns in volume average diameter, and with a narrow GSD of from about 1.15 to about 1.35, and preferably from about 1.19 to about 1.31 as measured by a Coulter Counter.

In a further object of the present invention there is provided a process for the preparation of toner compositions with certain effective particle sizes by controlling the temperature of the aggregation which comprises stirring and heating about below the resin glass transition temperature (Tg).

In a further object of the present invention there is provided a process for the preparation of toners with particle size distribution which can be improved from 1.4 to about 1.16 as measured by the Coulter Counter by increasing the temperature of aggregation from about 25° C. to about 45° C.

In a further object of the present invention there is provided a process that is rapid as, for example, the aggregation time can be reduced to below 1 to 3 hours by increasing the temperature from room, about 25° C., (RT) to a temperature below about 5° C. to 20° C. Tg and wherein the process consumes from about 2 to about 8 hours.

Moreover, in a further object of the present invention there is provided an economical process for the preparation of toner compositions which after fixing to paper substrates results in images with a gloss of from 20 GGU (Gardner Gloss Units) up to 70 GGU as measured by Gardner Gloss meter matching of toner and paper.

In another object of the present invention there is provided a composite toner of polymeric resin with pigment and optional charge control agent in high yields of from about 90 percent to about 100 percent by weight of toner without resorting to classification and wherein surfactants are avoided; and processes for dissitating a polar charged sodium sulfonated polyester resin in water with a homogenizer at about 25° C. to form an emulsion latex, followed by aggregation of the emulsion particles, and pigment with calcium chloride or similar chloride, and thereafter heating the aggregates to form coalesced toner particles of resin and pigment.

In yet another object of the present invention there are provided toner compositions with low fusing temperatures of from about 110° C. to about 150° C. and with excellent blocking characteristics at from about 50° C. to about 60° C.

Moreover, in another object of the present invention there are provided toner compositions with a high projection efficiency, such as from about 75 to about 95 percent efficiency as measured by the Match Scan II spectrophotometer available from Milton-Roy Inc.

In a further object of the present invention there are provided toner compositions which result in minimal, low or no paper curl.

These and other objects of the present invention are accomplished in embodiments by the provision of toners and processes thereof. In embodiments of the present invention, there are provided processes for the economical direct preparation of toner compositions by flocculation or heterocoagulation, and coalescence.

In embodiments, the present invention is directed to processes for the preparation of toner compositions which comprises initially attaining or generating a pigment dispersion, for example by dispersing an aqueous mixture of a pigment or pigments, such as carbon black like REGAL 330® obtained from Cabot Corporation, phthalocyanine, quinacridone or RHODAMINE B®, and generally cyan, magenta, yellow, or mixtures thereof, by utilizing a high shearing device, such as a Brinkmann Polytron, thereafter shearing this mixture by utilizing a high shearing device, such as a Brinkmann Polytron, a sonicator or microfluidizer with a suspended resin mixture comprised of a sulfonated polyester polymer component, adding a metal halide, such as magnesium chloride, calcium chloride, and the like to enable aggregation of the particles of the pigment and resin latex, and subsequently heating to enable coalescence. Heating is preferably accomplished above about the Tg of the sulfonated polyester.

The process of the present invention in embodiments comprises a process for the preparation of toner compositions comprising:

(i) preparing an emulsion latex comprised of sodio sulfonated polyester resin particles of preferably less than 0.1 micron in size diameter, and for example, from about 5 to about 500 nanometers, and in an amount of from about 1 to about 5 weight percent by heating said resin in water at a temperature of from about 45° C. to about 80° C.;

(ii) preparing a pigment dispersion in a water by dispersing in water from about 15 to about 25 weight percent of sulfonated polyester particles, and from about 1 to about 5 weight percent of pigment using a microfluidizer at from about 75° C. to about 85° C. for a duration of from about 1 hour to about 3 hours;

(iii) adding the pigment dispersion to a latex mixture comprised of sulfonated polyester resin particles in water with shearing, and followed by the addition of an alkali halide of from about 1 to about 2 weight percent in water until aggregation results as indicated by an increase in viscosity of from about 2 centipoise to about 100 centipoise;

(iv) heating the resulting mixture below about the resin Tg, and more specifically, at a temperature of from about 50° C. to about 90° C. thereby causing further aggregation and coalescence resulting in toner particles of from about 4 to about 9 microns in size with a geometric distribution of less than about 1.3; and optionally (v) cooling the product mixture to about 25° C., and followed by washing and drying.

In embodiments the present invention relates to a process for the preparation of toner compositions comprising:

(i) preparing an emulsion latex comprised of sodio sulfonated polyester resin particles of from about 5 to about 500 nanometers in size diameter by heating said resin in water at a temperature of from about 65 to about 90° C.;

(ii) preparing a pigment dispersion in a water by dispersing in water from about 10 to about 25 weight percent of sodio sulfonated polyester and from about 1 to about 5 weight percent of pigment;

(iii) adding the pigment dispersion to a latex mixture comprised of sulfonated polyester resin particles in water with shearing, followed by the addition of an alkali halide in water until aggregation results as indicated by an increase in the latex viscosity of from about 2 centipoise to about 100 centipoise;

(iv) heating the resulting mixture at a temperature of from about 45° C. to about 80° C. thereby causing further aggregation and enabling coalescence, resulting in toner particles of from about 4 to about 9 microns in volume average diameter and with a geometric distribution of less than about 1.3; and optionally (v) cooling the product mixture to about 25° C. and followed by washing and drying; a surfactant free process for the preparation of toner compositions comprising:

(i) preparing an emulsion latex comprised of sodio sulfonated polyester resin particles of less than 0.1 micron in size by heating said resin in water at a temperature of from about 15° C. to about 30° C. above its glass transition temperature;

(ii) preparing a pigment dispersion in water by dispersing in a 3 to 1 ratio said sulfonated polyester particles to water with pigment using a microfluidizer at from about 75° C. to about 85° C. for a duration of from about 1 hour to about 3 hours;

(iii) adding the pigment dispersion to a latex mixture comprised of sulfonated polyester resin particles in water with shearing, and followed by the addition of an alkali halide of from about 1 to about 2 weight percent in water until gellation occurred as indicated by an increase in viscosity of from about 2 centipoise to about 100 centipoise;

(iv) heating the resulting mixture below about the resin Tg at a temperature of from about 35° C. to about 50° C.

thereby causing further aggregation and coalescence to result in toner particles of from about 4 to about 9 microns in size with a geometric distribution of less than about 1.3; and (v) cooling the product mixture to about 25° C. and followed by washing and drying; and a process for the preparation of toner compositions comprising:

(i) preparing an emulsion latex comprised of sodio sulfonated polyester resin particles by heating said resin in water;

(ii) preparing a pigment dispersion in a water by dispersing in water a sodio sulfonated polyester and pigment;

(iii) adding the pigment dispersion to a latex mixture comprised of sulfonated polyester resin particles in water with shearing, followed by the addition of an alkali halide; and (iv) heating the resulting mixture thereby causing further aggregation and enabling coalescence.

One preferred method of obtaining the pigment dispersion depends on the form of the pigment utilized. In some instances, pigments available in the wet cake form or concentrated form containing water can be easily dispersed utilizing a homogenizer or stirring. In other instances, pigments are available in a dry form, whereby dispersion in water is preferably effected by microfluidizing using, for example, a M-110 microfluidizer and passing the pigment dispersion from 1 to 10 times through the chamber of the microfluidizer, or by sonication, such as using a Branson 700 sonicator.

The preferred resin is a sulfonated polyester, examples of which include those as illustrated in copending application U.S. Ser. No. 221,595, the disclosure of which is totally incorporated herein by reference, such as a sodio sulfonated polyester, and more specifically a polyester, such as poly(1,2-propylene-sodio 5-sulfoisophthalate), poly(neopentylene-sodio 5-sulfoisophthalate), poly(diethylene-sodio 5-sulfoisophthalate), copoly-(1,2-propylene-sodio 5-sulfoisophthalate)-copoly-(1,2-propyleneterephthalatephthalate), copoly-(1,2-propylene-diethylene-sodio 5-sulfoisophthalate)-copoly-(1,2-propylene-diethylene-terephthalatephthalate), copoly-(ethylene-neopentylene-sodio 5-sulfoisophthalate)-copoly-(ethylene-neopentylene-terephthalate-phthalate), copoly-(propoxylated bisphenol A)-copoly-(propoxylated bisphenol A-sodio 5-sulfoisophthalate). The sulfonated polyesters may in embodiments be represented by the following

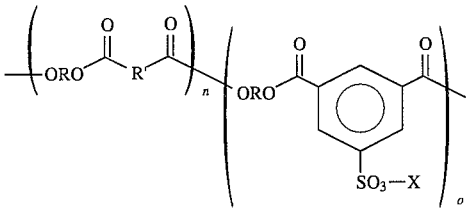

wherein R is an alkylene of from 2 to about 25 carbon atoms such as ethylene, propylene, butylene, or oxyalkylene diethyleneoxide, and the like; R' is an arylene of from about 6 to about 36 carbon atoms such as a benzylene, bisphenylene, bis(alkyloxy) bisphenolene, and the like. The said alkali sulfopolyester has a number average molecular weight ($M_n$) of from about 1,500 to about 50,000 grams per mole, a weight average molecular weight ($M_w$) of from about 6,000 grams per mole to about 150,000 grams per mole as measured by gel permeation chromatography and using polystyrene as standards.

Various known colorants or pigments present in the toner in an effective amount of, for example, from about 1 to about 25 percent by weight of the toner, and preferably in an amount of from about 1 to about 15 weight percent, that can be selected include carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610 ™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Specific examples of pigments include phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E. D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E. I. DuPont de Nemours & Company, and the like. Generally, colored pigments that can be selected are cyan, magenta, or yellow pigments, and mixtures thereof. Examples of magenta materials that may be selected as pigments include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used as pigments include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as pigments with the process of the present invention. The pigments selected are present in various effective amounts, such as from about 1 weight percent to about 65 weight and preferably from about 2 to about 12 percent, of the toner.

The toner may also include known charge additives in effective amounts of, for example, from 0.1 to 5 weight percent such as alkyl pyridinium halides, bisulfates, the charge control additives of U.S. Pat. Nos. 3,944,493; 4,007,293; 4,079,014; 4,394,430 and 4,560,635, which illustrates a toner with a distearyl dimethyl ammonium methyl sulfate charge additive, the disclosures of which are totally incorporated herein by reference, negative charge enhancing additives like aluminum complexes, and the like.

Examples of optional surfactants, which are added to the aggregated particles to "freeze" or retain particle size, and GSD achieved in the aggregation can be selected from the anionic surfactants such as sodium dodecylbenzene sulfonate, sodium dodecylnaphthalene sulfate, dialkyl benzenealkyl, sulfates and sulfonates, abitic acid, available from Aldrich, NEOGEN R™, NEOGEN SC™ obtained from Kao, and the like. They can also be selected from nonionic surfactants such as polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. An effective concentration of the anionic or nonionic surfactant generally employed as a "freezing agent" or stabilizing agent is, for example, from about 0.01 to about 10 percent by weight, and preferably from about 0.5 to about 5 percent by weight of the total weight of the aggregated particles comprised of resin latex, pigment particles, water, ionic and nonionic surfactants mixture.

Surface additives that can be added to the toner compositions after washing or drying include, for example, metal salts, metal salts of fatty acids, colloidal silicas, mixtures thereof and the like, which additives are usually present in an amount of from about 0.1 to about 2 weight percent, reference U.S. Pat. Nos. 3,590,000; 3,720,617; 3,655,374 and 3,983,045, the disclosures of which are totally incorporated herein by reference. Preferred additives include zinc stearate and AEROSIL R972® available from Degussa in amounts of from 0.1 to 2 percent which can be added during the aggregation process or blended into the formed toner product.

Developer compositions can be prepared by mixing the toners obtained with the processes of the present invention with known carrier particles, including coated carriers, such as steel, ferrites, and the like, reference U.S. Pat. Nos. 4,937,166 and 4,935,326, the disclosures of which are totally incorporated herein by reference, for example from about 2 percent toner concentration to about 8 percent toner concentration.

Imaging methods are also envisioned with the toners of the present invention, reference for example a number of the patents mentioned herein, and U.S. Pat. No. 4,265,990, the disclosure of which is totally incorporated herein by reference.

The following Examples are being submitted to further define various species of the present invention. These Examples are intended to be illustrative only and are not intended to limit the scope of the present invention. Also, parts and percentages are by weight unless otherwise indicated.

EXAMPLE I

(i) preparation of Sodio Sulfonate Polyester Emulsion

Dimethylterephthalate (388 grams), sodium dimethyl 5-sulfoisophthalate (44 grams), propanediol (302 grams), diethylene glycol (34.2) and butyltin oxide (0.8 gram) were charged in a 1 liter Parr reactor equipped with a mechanical stirrer and distillation apparatus. The mixture was heated to 175° C. for about 1 hour, and then the temperature was increased to 185° C. for an additional 3 hours during which time methanol byproduct was collected in the distillation receiver. The mixture was then raised to about 200° C., and the pressure was reduced from atmospheric pressure to about 0.5 Torrs over a period of about 2 hours. During this time, the excess glycol was collected in the distillation receiver. The product was then discharged through the bottom drain valve to result in the product, copoly(1,2-propylene-dipropylene-terephthalate)-copoly(1,2-propylene-dipropylene-5-sodiosulfo-isophthalate), with a glass transition temperature of about 54.6° C., a number average molecular weight ($M_n$) of 1,500 grams per mole, a weight average molecular weight ($M_w$) of 3,160 as measured by gel permeation chromatography using polystyrene as standard. 250 Grams of the above polyester resin were then heated with 750 grams of water at 75° C. for 1 hour to provide an emulsion of sulfonated polyester particles in water.

(ii) Preparation of Pigment Dispersion

30 Grams of dry pigment (PV FAST BLUE™) obtained from BASF were dispersed with 400 grams of the above sulfonated polyester emulsion using a microfluidizer at 80° C. for 1 hour.

(iii) Toner Preparation

75 Grams of the polyester resin emulsion resin of (i) were diluted with 75 grams of water, and mixed with 10 grams of pigment dispersion product of (ii) followed by shearing at 3,000 revolutions per minute using a Brinkmann polytron for a duration of about 2 minutes. The resulting mixture was then heated to 45° C. with stirring and to this was added dropwise about 30 grams of a 1 percent by weight solution of magnesium chloride in water, during which time the viscosity of mixture increased from about 2 centipoise to about 100 centipoise. Stirring was then continued for an additional hour, after which the temperature was raised to about 50° C. and the mixture was maintained at this temperature for about 2 hours to result in toner particles with an average particle size of about 9.6 microns and GSD of 1.28 as measured by the Coulter Counter.

(iv) Collection of Product

The above mixture was cooled to room temperature, about 25° C., filtered, washed with about 500 grams of water and dried using a freeze dryer.

EXAMPLE II

(i) Preparation of Sodio Sulfonate Polyester Emulsion

Dimethylterephthalate (400 grams), sodium dimethyl 5-sulfoisophthalate (22 grams), propanediol (302 grams), diethylene glycol (34.2) and butyltin oxide (0.8 gram) were charged in a 1 liter Parr reactor equipped with a mechanical stirrer and distillation apparatus. The mixture was heated to 175° C. for about 1 hour, and then the temperature was increased to 185° C. for an additional 3 hours during which time methanol byproduct was collected in the distillation receiver. The mixture temperature was then increased to about 200° C., and the pressure was reduced from atmospheric pressure to about 0.5 Torrs over a period of about 2 hours. During this time, the excess glycol was collected in the distillation receiver. The product was then discharged through the bottom drain valve to result in the product, copoly(1,2-propylene-dipropylene-terephthalate)-copoly(1,2-propylene-dipropylene-5-sodiosulfoisophthalate), with a glass transition temperature of about 56° C., a number average molecular weight ($M_n$) of 1,600 grams per mole, a weight average molecular weight ($M_w$) of 3,360 as measured by gel permeation chromatography using polystyrene as standard. 250 Grams of the above polyester resin were then heated with 750 grams of water at 75° C. for 1 hour to provide an emulsion of sulfonated polyester particles in water.

(ii) Preparation of Piqment Dispersion

30 Grams of dry pigment (PV FAST BLUE™), obtained from BASF, were dispersed with 400 grams of the above sulfonated polyester emulsion using a microfluidizer at 80° C. for 1 hour.

(iii) Toner Preparation

75 Grams of the polyester resin emulsion resin of (i) were diluted with 75 grams of water, and mixed with 10 grams of pigment dispersion product of (ii) followed by shearing at 3,000 revolutions per minute using a Brinkmann polytron for a duration of about 2 minutes. The mixture was then heated to 45° C. with stirring and to this mixture were added dropwise about 30 grams of a 1 percent by weight solution of magnesium chloride in water, during which time, the viscosity of mixture increased from about 2 centipoise to about 100 centipoise. Stirring was then continued for an additional hour, after which the temperature was raised to about 50° C. and maintained at this temperature for about 2 hours to result in toner particles with an average particle size of about 7.2 microns and GSD of 1.26 as measured by the Coulter Counter.

(iv) Collection of Product

The above mixture was cooled to room temperature, about 25° C. throughout, filtered off, washed with about 500 grams of water and dried using a freeze dryer.

EXAMPLE III (i) Preparation of Sodio Sulfonate Polyester Emulsion

Dimethylterephthalate (369 grams), sodium dimethyl 5-sulfoisophthalate (50 grams), propanediol (302 grams), diethylene glycol (34.2) and butyltin oxide (0.8 gram) were charged in a 1 liter Parr reactor equipped with a mechanical stirrer and distillation apparatus. The mixture was heated to 175° C. for about 1 hour, and then raised to 185° C. for an additional 3 hours during which time methanol byproduct was collected in the distillation receiver. The mixture temperature was then increased to about 200° C., and the pressure was reduced from atmospheric pressure to about 0.5 Torrs over a period of about 2 hours. During this time, the excess glycol was collected in the distillation receiver. The resin was then discharged through the bottom drain valve to result in the product, copoly(1,2-propylene-dipropylene-terephthalate)-copoly(1,2-propylene-dipropylene-5-sodiosulfo-isophthalate), with a glass transition temperature of about 51° C., a number average molecular weight ($M_n$) of 1,500 grams per mole, a weight average molecular weight ($M_w$) of 3,040 as measured by gel permeation chromatography using polystyrene as standard. 250 Grams of the above polyester resin were then heated with 750 grams of water at 75° C. for 1 hour to provide an emulsion of sulfonated polyester particles in water.

(ii) Preparation of Pigment Dispersion

30 Grams of dry pigment (PV FAST BLUE™), obtained from BASF, were dispersed with 400 grams of the above sulfonated polyester emulsion using a microfluidizer at 80° C. for 1 hour.

(iii) Toner Preparation

75 Grams of the polyester resin emulsion resin of (i) were diluted with 75 grams of water, and mixed with 10 grams of the pigment dispersion product of step (ii) followed by shearing at 3,000 revolutions per minute using a Brinkmann polytron for a duration of about 2 minutes. The mixture was then heated to 45° C. with stirring and to this was added dropwise about 30 grams of a 1 percent by weight solution of magnesium chloride in water, during which time the viscosity of mixture increased from about 2 centipoise to about 100 centipoise. Stirring was then continued for an additional hour, after which the temperature was raised to about 50° C. and maintained at this temperature for about 2 hours to result in toner particles with an average particle size of about 11 microns and GSD of 1.25 as measured by the Coulter Counter.

(iv) Collection of Product

The above mixture was cooled to room temperature, filtered off, washed with about 500 grams of water and dried using a freeze dryer.

Other embodiments and modifications of the present invention may occur to those of ordinary skill in the art subsequent to a review of the present application and the information presented herein; these embodiments and modifications, as well as equivalents thereof, are also included within the scope of this invention.

What is claimed is:

1. A process for the preparation of toner compositions comprising:

(i) preparing an emulsion latex comprised of sodium sulfonated polyester resin particles of from about 5 to about 500 nanometers in size diameter by heating said resin in water at a temperature of from about 65° C. to about 90° C.

(ii) preparing a pigment dispersion in a water by dispersing in water from about 10 to about 25 weight percent of sodium sulfonated polyester and from about 1 to about 5 weight percent of pigment;

(iii) adding the pigment dispersion to a latex mixture comprised of sodium sulfonated polyester resin particles in water with shearing, followed by the addition of an alkali halide in water until aggregation results as indicated by an increase in the latex viscosity of from about 2 centipoise to about 100 centipoise;

(iv) heating the resulting mixture at a temperature of from about 45° C. to about 80° C. thereby causing further aggregation and enabling coalescence, resulting in toner particles of from about 4 to about 9 microns in volume average diameter and with a geometric distribution of less than about 1.3; and optionally (v) cooling the product mixture to about 25° C. and followed by washing and drying.

2. A process in accordance with claim 1 wherein the alkali halide is berylium chloride, beryllure bromide, berylium iodide, magnesium chloride, magnesium bromide, magnesium iodide, calcium chloride, calcium bromide, calcium iodide, strontium chloride, strontium bromide, strontium iodide, barium chloride, barium bromide, and barium iodide.

3. A process in accordance with claim 1 wherein the particle size distribution of the aggregated particles is about 1.40 decreasing to about 1.16, when the temperature is increased from room temperature, about 25° C. to about 50° C., and wherein said temperature is below the resin Tg.

4. A process in accordance with claim 1 wherein shearing in (ii) is accomplished, and said shearing is completed by homogenizing at from about 1,000 revolutions per minute to about 10,000 revolutions per minute, at a temperature of from about 25° C. to about 35° C., and for a duration of from about 1 minute to about 120 minutes.

5. A process in accordance with claim 1 wherein the dispersion of (ii) is accomplished by microfluidization in a microfluidizer, or in nanojet for a duration of from about 1 minute to about 120 minutes.

6. A process in accordance with claim 1 wherein shearing or homogenization in (iii) is accomplished by homogenizing at from about 1,000 revolutions per minute to about 10,000 revolutions per minute for a duration of from about 1 minute to about 120 minutes.

7. A process in accordance with claim 1 wherein the resin of (i) is a polyester of poly(1,2-propylene-sodio 5-sulfoisophthalate), poly(neopentylene-sodio 5-sulfoisophthalate), poly(diethylene-sodio 5-sulfoisophthalate), copoly-(1,2-propylene-sodio 5-sulfoisophthalate)-copoly-(1,2-propylene-terephthalatephthalate), copoly-(1,2-propylenediethylenesodio 5-sulfoisophthalate)-copoly-(1,2-propylene-diethyleneterephthalatephthalate), copoly-(ethylene-neopentylene-sodio 5-sulfoisophthalate)-copoly-(ethylene-neopentylene-terephthalatephthalate), or copoly-(propoxylated bisphenol A)-copoly-(propoxylated bisphenol A-sodio 5-sulfoisophthalate).

8. A process in accordance with claim 2 wherein the resin of (i) is a polyester of poly(1,2-propylene-sodio 5-sulfoisophthalate), poly(neopentylene-sodio 5-sulfoisophthalate), poly(diethylene-sodio 5-sulfoisophthalate), copoly-(1,2-propylene-sodio 5-sulfoisophthalate)-copoly-(1,2-propylene-terephthalatephthalate), copoly-(1,2-propylene-diethylenesodio 5-sulfoisophthalate)-copoly-(1,2-propylene-diethylene-terephthalatephthalate), copoly-(ethylene-neopentylene-sodio 5-sulfoisophthalate)-copoly-(ethylene-neopentylene-terephthalate-phthalate), or copoly-(propoxylated bisphenol A)-copoly-(propoxylated bisphenol A-sodio 5-sulfoisophthalate).

9. A process in accordance with claim 1 wherein the pigment is carbon black, magnetite, cyan, yellow, magenta, and mixtures thereof.

10. A process in accordance with claim 1 wherein the resin utilized in (ii) is from about 0.01 to about 0.2 micron in volume average diameter, and the pigment particles are from about 0.01 to about 1 micron in volume average diameter.

11. A process in accordance with claim 1 wherein the toner particles isolated are from about 2 to about 15 microns in volume average diameter, and the geometric size distribution thereof is from about 1.15 to about 1.35.

12. A process in accordance with claim 1 wherein there is added to the surface of the formed toner metal salts, metal salts of fatty acids, silicas, metal oxides, or mixtures thereof in an amount of from about 0.1 to about 10 weight percent of the obtained toner particles.

13. A process in accordance with claim 1 wherein the toner particles obtained after cooling are from about 3 to 15 microns in volume average diameter, and the geometric size distribution thereof is from about 1.15 to about 1.30.

14. A process in accordance with claim 1 wherein heating in (iii) is from about 5° C. to about 25° C. below the resin Tg.

15. A process in accordance with claim 1 wherein heating in (iv) is from about 5° C. to about 50° C. above the resin Tg.

16. A process in accordance with claim 1 wherein the resin Tg in (iv) is from about 50° C. to about 65° C.

17. A surfactant free process for the preparation of toner compositions comprising:

(i) preparing an emulsion latex comprised of sodium sulfonated polyester resin particles of less than 0.1 micron in size by heating said resin in water at a temperature of from about 15 to about 30° C. above its glass transition temperature;

(ii) preparing a pigment dispersion in water by dispersing in a 3 to 1 ratio said sodium sulfonated polyester particles to water with pigment using a microfluidizer at from about 75° C. to about 85° C. for a duration of from about 1 hour to about 3 hours;

(iii) adding the pigment dispersion to a latex mixture comprised of sodium sulfonated polyester resin particles in water with shearing, and followed by the addition of an alkali halide of from about 1 to about 2 weight percent in water until gellation occurred as indicated by an increase in viscosity of from about 2 centipoise to about 100 centipoise;

(iv) heating the resulting mixture below about the resin Tg at a temperature of from about 35° C. to about 80° C. thereby causing further aggregation and coalescence to result in toner particles of from about 4 to about 9 microns in size with a geometric distribution of less than about 1.3; and (v) cooling the product mixture to about 25° C., and followed by washing and drying.

18. A process for the preparation of toner compositions comprising:

(i) preparing an emulsion latex comprised of sodium sulfonated polyester resin particles by heating said resin in water;

(ii) preparing a pigment dispersion in a water by dispersing in water a sodium sulfonated polyester and pigment;

(iii) adding the pigment dispersion to a latex mixture comprised of sodium sulfonated polyester resin particles in water with shearing, followed by the addition of an alkali halide; and (iv) heating the resulting mixture thereby causing further aggregation and enabling coalescence.

19. A process in accordance with claim 18 wherein subsequent to (iv) the product mixture is cooled, followed by washing and drying to enable said toner compositions.

20. A process in accordance with claim 18 wherein subsequent to (iv) the product mixture is cooled to about 25° C.

21. A process in accordance with claim 1 wherein in (ii) the pigment dispersion is prepared with a microfluidizer at from about 75° C. to about 85° C. for a duration of from about 1 hour to about 3 hours.

22. A process in accordance with claim 1 wherein subsequent to (iv) the toner compositions or particles resulting are (v) cooled to about 25° C., and followed by washing and drying.

23. A process in accordance with claim 18 wherein the pigment dispersion is prepared with a microfluidizer at from about 75° C. to about 85° C. for a duration of from about 1 hour to about 3 hours.

* * * * *